United States Patent [19]

Conger, IV

[11] 4,248,570

[45] Feb. 3, 1981

[54] AIR BLOWER FOR SPAS OR THE LIKE

[76] Inventor: William W. Conger, IV, 9552 Orange Ave., Anaheim, Calif. 92804

[21] Appl. No.: 896,998

[22] Filed: Apr. 17, 1978

[51] Int. Cl.[2] ..... F01D 17/18

[52] U.S. Cl. ..... 415/148; 417/424; 417/572

[58] Field of Search ..... 128/66; 417/423 R, 424; 415/126, 127, 148; 239/443, 444, 447, 265.25, 265.27, 265.29; 60/229; 137/565.1, 876

[56] References Cited

U.S. PATENT DOCUMENTS

| | | | |
|---|---|---|---|
| 952,522 | 3/1910 | Hendryx | 415/148 |
| 1,393,977 | 10/1921 | Saul | 60/229 |
| 1,616,566 | 2/1927 | Barker | 415/148 |
| 1,714,917 | 5/1929 | Martin | 415/148 |
| 2,398,380 | 4/1946 | Kisling | 415/148 |
| 3,245,620 | 4/1966 | McEwen | 60/229 X |
| 3,674,020 | 7/1972 | Jacuzzi | 128/66 |
| 3,809,073 | 5/1974 | Baumann | 128/66 |

*Primary Examiner*—Carlton R. Croyle
*Assistant Examiner*—Edward Look
*Attorney, Agent, or Firm*—Philip M. Hinderstein

[57] ABSTRACT

In an air blower of the type including a housing having an air inlet and a motor and a fan positioned in the housing, there is disclosed an improvement wherein the housing has first and second outlets and a pivotable plate for selectively sealing either of the outlets so that a single blower can be used to drive two different air flow systems. The housing also has a mechanical device for controlling the rate of air flow into the outlets.

2 Claims, 5 Drawing Figures

AIR BLOWER FOR SPAS OR THE LIKE

BACKGROUND OF THE INVENTION

1. Field of the Invention

The present invention relates to an air blower for spas or the like and, more particularly, to an air blower for spas or the like including dual outputs and mechanical means for controlling the rate of air flow into the outputs.

2. Description of the Prior Art

While swimming pools and spas have been popular for many years, recent years have witnessed a significant upsurge in interest in spas, also referred to as hut tubs. In many cases, the spas are molded in one piece from fiberglass and other materials. Alternatively, a hot tub is made from dried redwood in which the tub walls are formed of individual staves secured to a floor and held in position by steel hoops.

In either event, a complete spa contains a support system including most of the elements found in use with a swimming pool or a jacuzzi. The water must be heated and filtered and a pump included for circulating same. A variety of valves and fittings are utilized to control flow rate, rise time, and sensitivity.

Virtually all such spas incorporate a closed loop water circulation system, including one or more hydro-massage jet fittings for mixing air with the water before pumping the water into the spa. By this means, the water in the spa in agitated, creating a hydro-massage action. In a typical installation, one or more of such fittings are positioned in the side wall of the spa, each fitting being connectable to a source of water and a source of air for conducting water and air into the tub. In many installations, an air blower is connected to the air line for pumping air into the tub. Such a hydro-massage jet system provides a vigorous massaging action.

Many of such spas also incorporate a floor or seat bubbler system for pumping a large number of air bubbles into the water in the spa. A perforated channel made integral with a one-piece spa or a perforated ring mounted underneath a seat or on the floor of a tub is connected via an air line to an air blower. This type of system turns a spa into a bubbling, swirling, invigorating bath, but one which is less vigorous than a hydro-massage jet system.

In spas utilizing both a hydro-massage jet system and a floor or seat bubbler system, it has been the usual practice to include two air blowers even though only one system is to be used at a time. This has been inefficient and uneconomical.

Furthermore, it has been common practice to provide the air blower or blowers with a means for controlling the motor speed so as to control the rate of air flow into the spa. In the past, such means included a rheostat or other electrical control apparatus for controlling the motor speed. However, the motor is typically self-cooled by the air flowing through the blower housing. Therefore, a decrease in the motor speed decreases the air flowing through the housing. As a typical motor slows down, it reaches a point where there is insufficient air flowing through the housing to adequately cool the motor. The result is overheating and burning out of blower motors. As a result, this solution to controlling the air flow rate has been unsatisfactory.

SUMMARY OF THE INVENTION

According to the present invention, these problems are solved by the provision of a novel air blower for spas or the like. The present air blower is designed to drive two different air flow systems, such as a floor or seat bubbler system and a hydro-massage jet system. The present blower can be used to drive either system or both. Furthermore, the present air blower includes a totally mechanical means for controlling the rate of air flow into the outlets of the blower without changing the speed of the motor or the amount of air flowing through the housing so that all overheating problems are completely eliminated.

Briefly, in an air blower of the type including a housing having an air inlet and a motor and a fan positioned in the housing, the present invention is an improvement wherein the housing has first and second outlets therein positioned side-by-side in one wall of the housing and a pivotable plate is provided for selectively sealing either of the outlets whereby the air may be conducted into either the first outlet or the second outlet or both. According to one embodiment of the invention, the blower further includes a threaded, hollow neck projecting from the housing, the neck providing a third outlet for the housing, and a threaded cap engaging the neck and sealing same, the cap having at least one hole in the side thereof, the hole being blocked by the neck to prevent air flow therethrough in one position of the cap and being clear of the neck to permit air flow therethrough in another position of the cap.

It is therefore an object of the present invention to provide an air blower for spas or the like.

It is a further object of the present invention to provide an air blower which can be utilized to selectively drive two air flow systems.

It is a still further object of the present invention to provide an air blower including an inexpensive mechanical means for controlling the rate of air flow into the outlet thereof.

It is another object of the present invention to provide an air blower which eliminates overheating problems when controlling the rate of air pumped thereby.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 2:
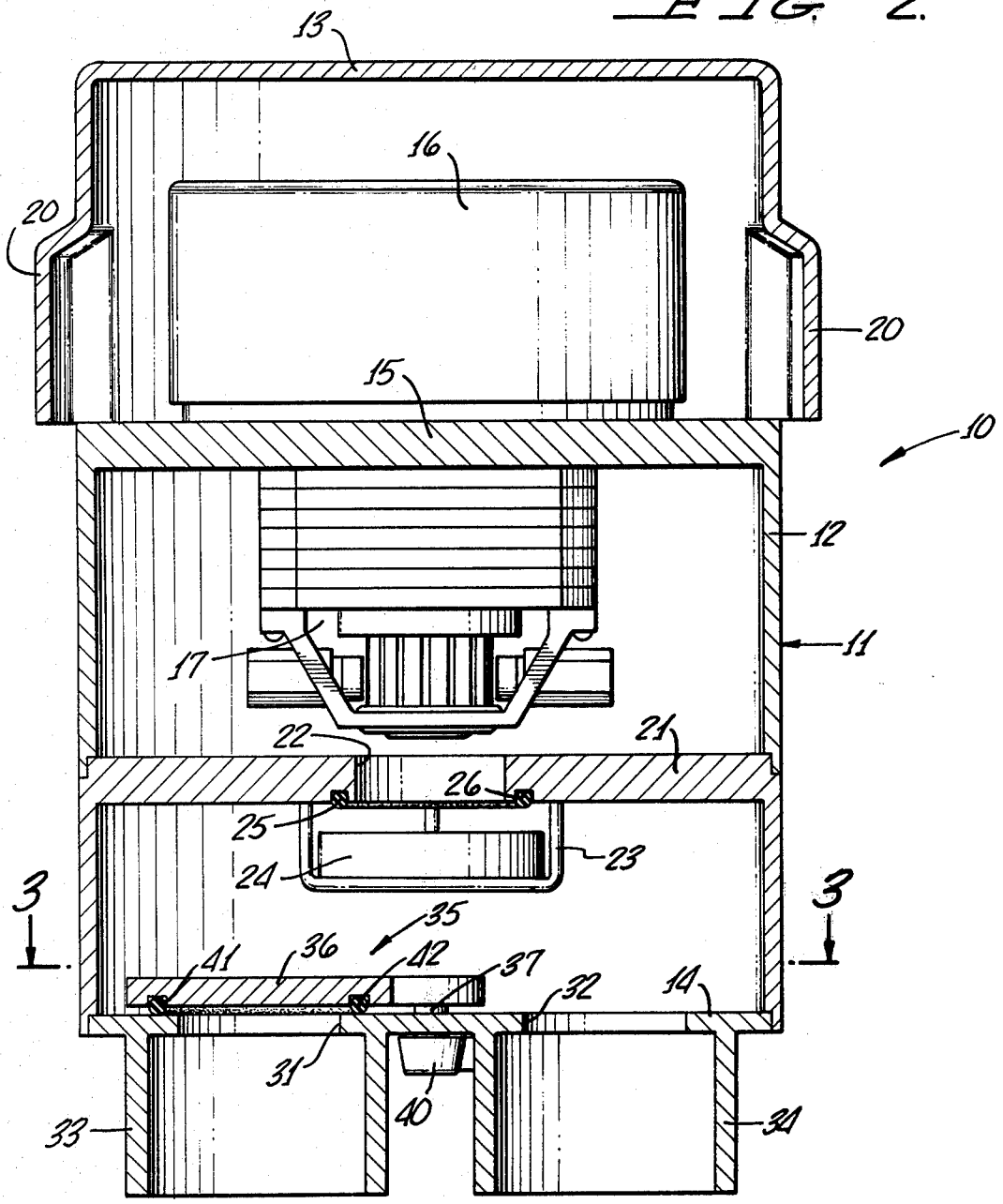
FIG. 2 is an enlarged sectional view taken along the line 2—2 in FIG. 1.

Referring now to the drawings, the present air blower, generally designated 10, includes a generally elongate, cylindrical housing 11 having a cylindrical side wall 12, a planar top wall 13, and a planar bottom wall 14. Housing 11 may be made in multiple pieces, for convenience, as shown in FIG. 2, but this is conventional in the art and not a part of the present invention.

As is known in the art, blower 10 includes a support member 15 extending across the inside of housing 11 for supporting a motor 17 and a fan (not shown) positioned within a fan housing 16. Motor 17 is connected to a source of input voltage (not shown) and to an on/off switch 19 mounted in side wall 12. Housing 11 includes a pair of handles 20 which also function as air inlets on opposite sides of fan housing 16. The fan draws air into housing 11, through inlets 20, and directs such air downwardly, past motor 17 for cooling of same.

As is also known in the art, housing 11 has a disc-shaped support member 21 extending thereacross, below motor 17, support member 21 having a central hole 22 through which air is conducted by the fan. A cage structure 23 supports a float 24 below hole 22 in support member 21. A sealing gasket 25 in a groove 26 in support member 21 extends around hole 22 therein. If water backs up into housing 11 and starts to rise therein, float 24 will be elevated into contact with gasket 25 to prevent the flow of water through hole 22, which water would damage motor 17 and/or the fan.

Bottom wall 14 of housing 11 has a pair of holes 31 and 32 therein which provide first and second outlets for blower 10. First and second hollow necks 33 and 34 preferably project from wall 14, coaxially with holes 31 and 32, respectively, to provide a means for connecting air conduits to blower 10. Accordingly, the air from the fan can be conducted through hole 22 and through both holes 31 and 32 so that air blower 10 can drive two different air flow systems.

Figure 3:
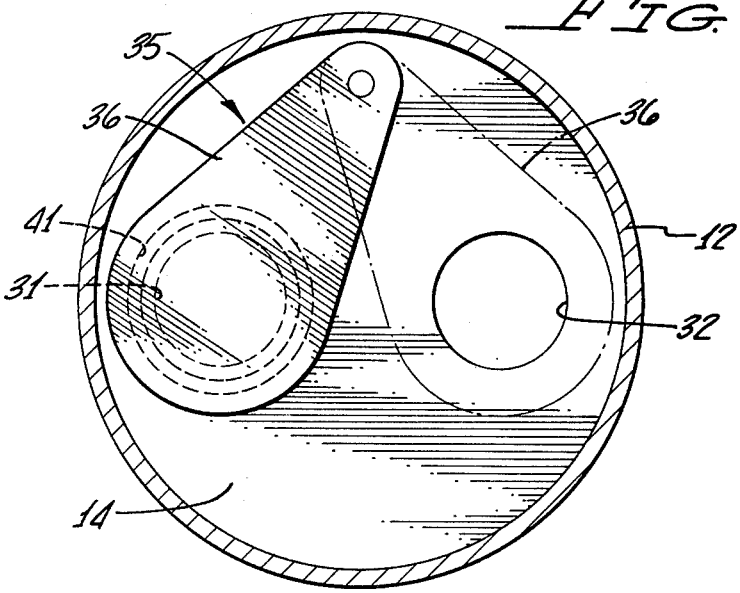
FIG. 3 is a sectional view taken along the line 3—3 in FIG. 2.

According to the present invention, blower 10 includes means, generally designated 35, for selectively sealing either of holes 31 or 32. Sealing means 35 preferably comprises a plate 36 movable between a position in front of hole 31 and a position in front of hole 32. Specifically, plate 36 is connected to one end of a shaft 37 which extends through a hole 38 in wall 14 of housing 11. An O-ring 39, surrounding shaft 37, seals hole 38. A knob 40 connected to the other end of shaft 38 permits rotation thereof. Accordingly, rotation of knob 40 permits pivotal movement of plate 36 between the position shown in solid lines in FIG. 3 and the position shown in phantom in FIG. 3.

The surface of plate 36 which faces wall 14 has a groove 41 therein having a diameter which is larger than the diameter of holes 31 and 32. Groove 41 receives an O-ring 42 which contacts the inner surface of wall 14 and provides a seal. Therefore, with plate 36 in the position shown in solid lines in FIG. 3, air from the fan is conducted exclusively out of hole 32 in housing 11. With plate 36 in the position shown in phantom in FIG. 3, air from the fan flows exclusively out of hole 31 in housing 11. It is obvious from an inspection of FIG. 3 that plate 36 can be moved to a position between those shown to permit air flow through both of holes 31 and 32.

Figure 1:
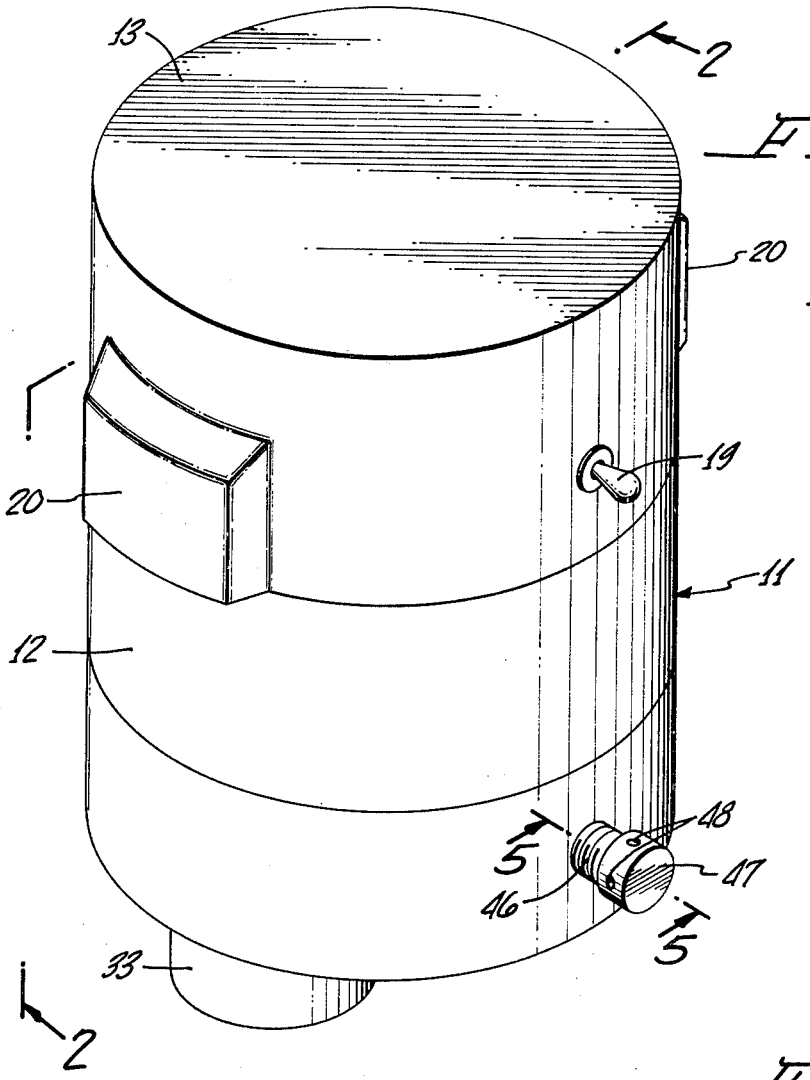
FIG. 1 is a perspective view of an air blower for spas or the like constructed in accordance with the teachings of the present invention.
Figure 5:
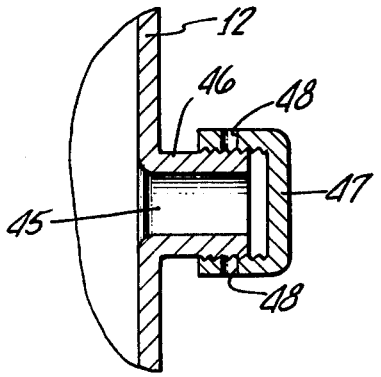
FIG. 5 is an enlarged sectional view taken along the line 5—5 in FIG. 1.
Figure 4:
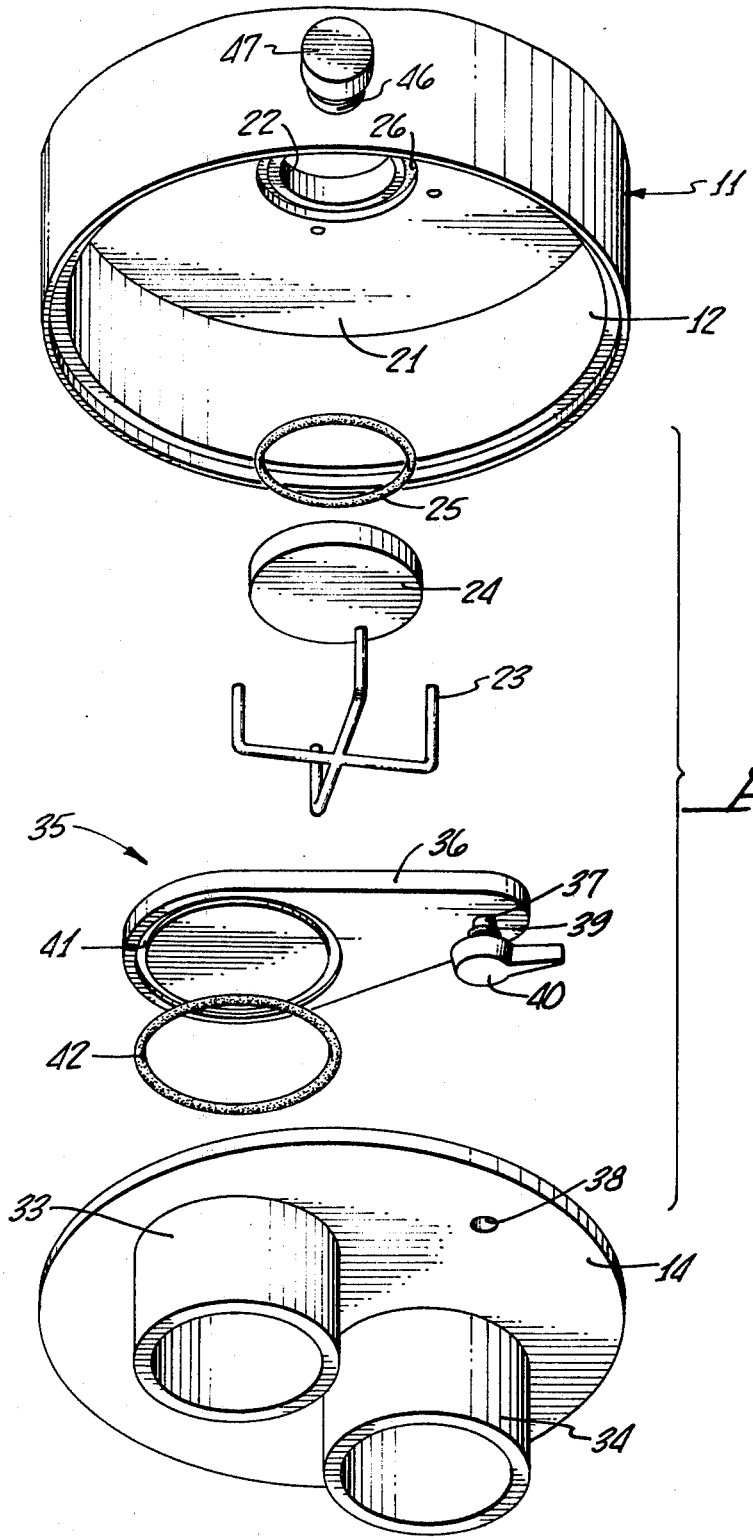
FIG. 4 is an exploded perspective view of a portion of the air blower of FIG. 1.

Referring now to FIGS. 1, 4, and 5, housing 11 has a hole 45 in side wall 12, between support member 21 and bottom wall 14, hole 45 being capable of functioning as a third outlet in housing 11. Projecting from wall 12, coaxially with hole 45, is an externally threaded, hollow neck 46. Engaging neck 46 is a threaded cap 47 which seals hole 45 and prevents air flow therethrough. On the other hand, cap 47 has a plurality of holes 48 in the side thereof.

In the position of cap 47 shown in FIG. 5, holes 48 are blocked by neck 46 to prevent air flow through hole 45. On the other hand, as cap 47 is withdrawn, by rotating same, holes 48 reach the end of neck 46 so that air can be conducted through neck 46 and out through holes 48. Since the pressure adjacent holes 48 is typically atmospheric and holes 31 and 32 are typically connected via air lines to a position under water where the pressure is substantially higher, holes 48 function to bleed-off a substantial portion of the air that the fan pumps through hole 22. Thus, by the simple expedient of manipulating cap 47, the rate of air flow into outlet 31 and/or outlet 32 can be effectively controlled over a wide range.

It can therefore be seen that according to the present invention, the problems discussed hereinbefore are solved by the provision of a novel air blower 10 for spas or the like. Air blower 10 is designed to drive two different air flow systems, such as a floor or seat bubbler system and a hydro-massage jet system. Blower 10 can be used to drive either system or both. Furthermore, blower 10 includes a totally mechanical means for controlling the rate of air flow into the outlets of housing 11, which means does not change the speed of motor 17 or the amount of air flowing through housing 11. This eliminates all over-heating problems.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In an air blower of the type including a housing having an air inlet, an air outlet, and a motor and a fan positioned in said housing between said inlet and said outlet, the improvement comprising:

a second outlet in said housing;

a threaded, hollow neck projecting from said housing, coaxially with said second outlet; and a threaded cap engaging said neck and preventing air flow therethrough, said cap having at least one hole in the side thereof, said hole being blocked by said neck to prevent air flow therethrough in one position of said cap and being clear of said neck to permit air flow therethrough in another position of said cap.

2. In an air blower according to claim 1, the improvement wherein said cap has a plurality of holes therein.

* * * * *